US009666971B1

(12) United States Patent
Lai et al.

(10) Patent No.: US 9,666,971 B1
(45) Date of Patent: May 30, 2017

(54) CONNECTOR COVER AND CONNECTOR MODULE

(71) Applicant: GIGA-BYTE TECHNOLOGY CO.,LTD., New Taipei (TW)

(72) Inventors: Chih-Ming Lai, New Taipei (TW); Chung-Wei Chiang, New Taipei (TW); Yung-Shun Kao, New Taipei (TW)

(73) Assignee: GIGA-BYTE TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 15/077,930

(22) Filed: Mar. 23, 2016

(30) Foreign Application Priority Data

Nov. 27, 2015 (TW) ..... 104139572 A

(51) Int. Cl.
*H01R 13/62* (2006.01)
*H01R 13/502* (2006.01)
*H01R 13/629* (2006.01)
*H01R 13/652* (2006.01)

(52) U.S. Cl.
CPC ..... *H01R 13/5025* (2013.01); *H01R 13/629* (2013.01); *H01R 13/652* (2013.01)

(58) Field of Classification Search
CPC H01R 13/62; H01R 12/7076; H01R 13/5025; H01R 13/629; H01R 4/66
USPC ..... 439/630, 629, 352, 152, 607, 327, 439/607.54, 607.1, 159
See application file for complete search history.

(56) References Cited

U.S. PATENT DOCUMENTS 5,478,259 A * 12/1995 Noschese ..... H01R 12/721 439/108
5,842,880 A * 12/1998 Pei ..... H01R 12/7005 439/327
5,957,708 A * 9/1999 Lin ..... H01R 12/7005 439/157
6,093,046 A * 7/2000 Chiou ..... H01R 12/7005 439/378
6,322,388 B1 * 11/2001 Akio ..... H01R 13/5812 439/459
6,663,402 B1 * 12/2003 Yu ..... H01R 13/65802 439/108
6,672,887 B1 * 1/2004 Yu ..... H01R 13/65802 439/108
6,695,630 B1 * 2/2004 Ku ..... H05K 7/1431 439/152

(Continued)

*Primary Examiner* — Abdullah Riyami
*Assistant Examiner* — Nader Alhawamdeh
(74) *Attorney, Agent, or Firm* — Jianq Chyun IP Office

(57) ABSTRACT

A connector cover adapted to cover a connector is provided. Two protrusions protruding from two ends of a connector body of the connector have two protrusion inner walls facing to each other and two grooves caved in the protrusion inner walls. The connector cover includes a cover body, having a cover top surface, and at least one cover protrusion disposed at a side of the cover body and protruding from the cover top surface. Each cover protrusion includes two cover protrusion side surfaces and at least one covering portion. Each covering portion, extending from one of the cover protrusion side surfaces and bending along outline of the protrusion protrusion inner wall to cover at least a portion of the protrusion protrusion inner wall, includes a protruding arm adapted to be located in the groove A cover module is further provided.

20 Claims, 6 Drawing Sheets

(56) References Cited

U.S. PATENT DOCUMENTS

| | | | | |
|---|---|---|---|---|
| 6,821,149 | B2 * | 11/2004 | Lai | H01R 23/6873 439/607.31 |
| 7,108,554 | B2 * | 9/2006 | Huang | H01R 23/6873 439/378 |
| 7,207,815 | B1 * | 4/2007 | Ju | H01R 12/7029 439/159 |
| 7,771,232 | B2 * | 8/2010 | Si | H01R 23/6873 439/607.01 |
| 8,038,459 | B2 * | 10/2011 | Hayauchi | H01R 13/5213 439/301 |
| 8,092,239 | B2 * | 1/2012 | Nishiyama | H01R 12/7005 439/157 |
| 8,794,988 | B2 * | 8/2014 | Tanaka | H01R 12/83 439/326 |
| 2005/0277334 | A1 * | 12/2005 | Huang | H01R 23/6873 439/607.01 |
| 2007/0254526 | A1 * | 11/2007 | Lai | H05K 1/18 439/637 |
| 2010/0323549 | A1 * | 12/2010 | Hayauchi | H01R 13/5213 439/357 |
| 2012/0135618 | A1 * | 5/2012 | Shen | H01R 13/62988 439/152 |
| 2013/0084723 | A1 * | 4/2013 | Shen | H01R 12/7029 439/159 |
| 2015/0318627 | A1 * | 11/2015 | Berry, Jr. | H01R 12/7076 714/6.32 |
| 2016/0020539 | A1 * | 1/2016 | Li | H01R 12/707 439/155 |
| 2016/0020540 | A1 * | 1/2016 | Shen | G06F 1/203 439/155 |

* cited by examiner 112
116b
100b

CONNECTOR COVER AND CONNECTOR MODULE

CROSS-REFERENCE TO RELATED APPLICATION

This application claims the priority benefit of Taiwan application serial no. 104139572, filed on Nov. 27, 2015. The entirety of the above-mentioned patent application is hereby incorporated by reference herein and made a part of this specification.

BACKGROUND OF THE INVENTION

Field of the Invention

The invention relates to a connector cover and a connector module, and relates particularly to a connector cover and a connector module capable of enhancing a strength of a connector and provide a good fixing effect for an expansion card.

Description of Related Art

With the advance of science and technology in recent years, the performance of an expansion device in a computer host is continuously improving. Taking a memory module as an example, when the memory module is operated at a high performance mode, a considerable amount of heat is generated. In order to facilitate the dissipation of heat, a fan may be disposed at a side of a high-level memory module to promptly dissipate the heat generated by the chip on the memory module through convection. However, since this kind of memory module is heavier, when the memory module is inserted into the connector on the main board, the housing of the connector may be broken.

In addition, in a traditional connector, typically when two protrusions which are located on the left and right ends of the connector and for latching on to the two ends of the expansion card are molded, two plastic latches are molded on each of the protrusions respectively at the same time. In this way, when the expansion card is inserted into the connector, two of the plastic latches may be located in the depressed contours of one end of the expansion card to provide an effect to fix the memory module. Or, traditional connectors may also use additional metal pieces which are inserted into the protrusions at the left and right two ends of the connector to act as two sets of metal latches for latching onto the left and right two sides of the memory module. However, problems exist such as easy wear of the plastic latches due to poor durability against plugging and pulling, and difficulty to control the dimensions of the molded part. The metal latch is considered a blanking type cross section, wherein being too tight may cause scratching to the sides of the memory module and being too loose may adversely affect the latching function. In addition, manufacturing of the metal latches require additional manufacturing steps.

SUMMARY OF THE INVENTION

The invention provides a connector cover, capable of increasing a connection strength and provides an expansion card with a good fixing effect.

The invention provides a connector module, which has the aforementioned connector cover.

A connector cover of the invention is adapted to cover a connector. The connector includes a connector body and two protrusions. The connector body includes a connector top surface and four connector side surfaces. The connector top surface includes a connector slot. The two protrusions are respectively located at two ends of the connector body and protrude from the connector top surface. The two protrusions respectively include two protrusion inner walls face towards each other and two grooves caved in the protrusion inner walls. The two grooves communicate to the connector slot. The connector cover includes a cover body and at least one cover protrusion. The cover body includes a cover top surface and four cover side surfaces. The cover top surface is adapted to cover the connector top surface and includes an opening corresponding to the connector slot. The four cover side surfaces are adapted to cover the four connector side surfaces, wherein two of the cover side surfaces which are opposite to each other connect to the cover top surface. The at least one cover protrusion is located at at least one end of the cover body and protrudes from the cover top surface. Each of the cover protrusions includes two cover protrusion side surfaces and at least one covering portion. The two cover protrusion side surfaces are adapted to cover two of the connector side surfaces which are opposite to each other. Each of the covering portions extend from one of the cover protrusion side surfaces and is adapted to curve along a contour of the protrusion inner wall and cover at least a part of the protrusion inner wall. Each of the covering portions includes a protruding arm, wherein the protruding arm is adapted to extend into the groove.

A connector module of the invention includes a connector and a connector cover. The connector includes a connector body and two protrusions. The connector body includes a connector top surface and four connector side surfaces. The connector top surface includes a connector slot. The two protrusions are respectively located at two ends of the connector body and protrude from the connector top surface. The two protrusions respectively include two protrusion inner walls facing towards each other and two grooves caved in the two protrusion inner walls. The two grooves communicate to the connector slot. The connector cover includes a cover body and at least one cover protrusion. The cover body includes a cover top surface and four cover side surfaces. The cover top surface covers the connector top surface and includes an opening corresponding to the connector slot. The four cover side surfaces cover the four connector side surfaces, wherein the two opposite cover side surfaces connect to the cover top surface. The at least one cover protrusion is located at at least one end of the cover body and protrudes from the cover top surface. Each of the cover protrusions include two cover protrusion side surfaces and at least one covering portion. The two cover protrusion side surfaces cover two of the connector side surfaces which are opposite to each other. Each of the covering portions extends from one of the cover protrusion side surfaces and curves along a contour of the protrusion inner wall and covers at least a part of the protrusion inner wall. Each of the covering portions includes a protruding arm, wherein the protruding arm extends into the groove.

In an embodiment of the invention, each of the cover protrusions includes two of the covering portions which respectively extend from the two opposite cover protrusion side surfaces and curve, and is adapted to cover two opposite surfaces of the protrusion inner wall.

In an embodiment of the invention, each of the cover protrusions includes one of the covering portions, which extends from one of the cover protrusion side surfaces and is adapted to curve at least twice along the contour of the protrusion inner wall and cover a bottom surface of the groove, and the protruding arm is located on a part of the covering portion covering the bottom surface of the groove.

In an embodiment of the invention, the covering portion is attached to the entire protrusion inner wall.

In an embodiment of the invention, the connector top surface of the connector includes a pin-less hole region and a depressed part depressed in the pin-less hole region, the cover top surface includes an engaging part, the engaging part extending into the depressed part, the depressed part is located at an edge of the connector top surface, a depth of the depressed part is greater than or equal to a thickness of the engaging part.

In an embodiment of the invention, the connector top surface of the connector includes a pin-less hole region and a depressed part depressed in the pin-less hole region, the cover top surface includes an engaging part, the depressed part is not located at an edge of the connector top surface, the engaging part is bent so that an end of the engaging part extends into the depressed par.

In an embodiment of the invention, the connector cover further includes at least one connecting pin, extending from one of the cover side surfaces, wherein the connector cover is adapted to connect to a main board by the at least one connecting pin.

In an embodiment of the invention, the at least one connecting pin is a ground pin.

In an embodiment of the invention, each of the connecting pins has a rough surface, a bending part or a breach, the rough surface includes a sand blasted surface or includes a plurality of uniform or non uniform strips or bumps.

In an embodiment of the invention, each of the protrusions includes two positioning grooves located at two outer surfaces opposite to each other, the two opposite cover protrusion side surfaces includes two positioning an is slanted towards each other, top ends of the two positioning arms are adapted to abut against upper wall surfaces of the two positioning grooves.

Based on the above, in the invention, in addition to a connector cover covers a connector such that the connector module may have better strength, the connector cover also has a design wherein a covering portion of a cover protrusion extends from one of the cover protrusion side surfaces and curves along a contour of an protrusion inner wall and covers at least a part of the protrusion inner wall and an protruding arm of the covering portion extends into a groove, such that the protruding arm may be used to act, for example, as a latch to fix a concaved portion of a side surface of a expansion card such as a memory module. A material of the connector cover may be metal and is more durable compared to a plastic latch that is molded together with the connector. In addition, compared to a conventional method of additionally inserting a metal latch in the connector, while the connector cover of the invention is assembled to the connector, the protruding arm is positioned, and does not require additional components or processing steps. Furthermore, compared to a conventional connector, because the location of the protruding arm is more controllable, the issue that it is difficult to control the tight or loose situation between the two opposite protruding arms can be prevented.

Several exemplary embodiments accompanied with figures are described in detail below to further describe the disclosure in details.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
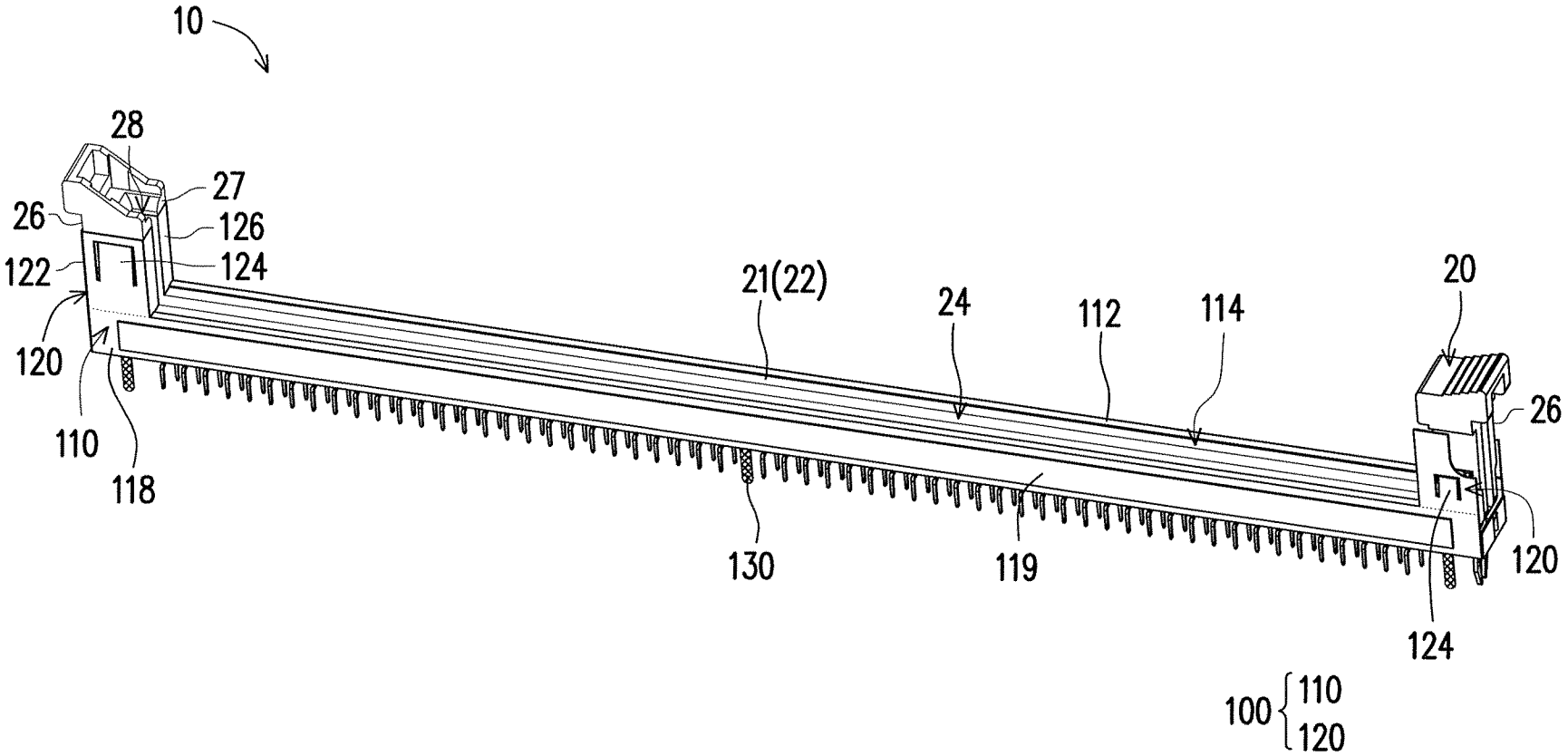
FIG. 1 is a schematic diagram illustrating a connector module according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
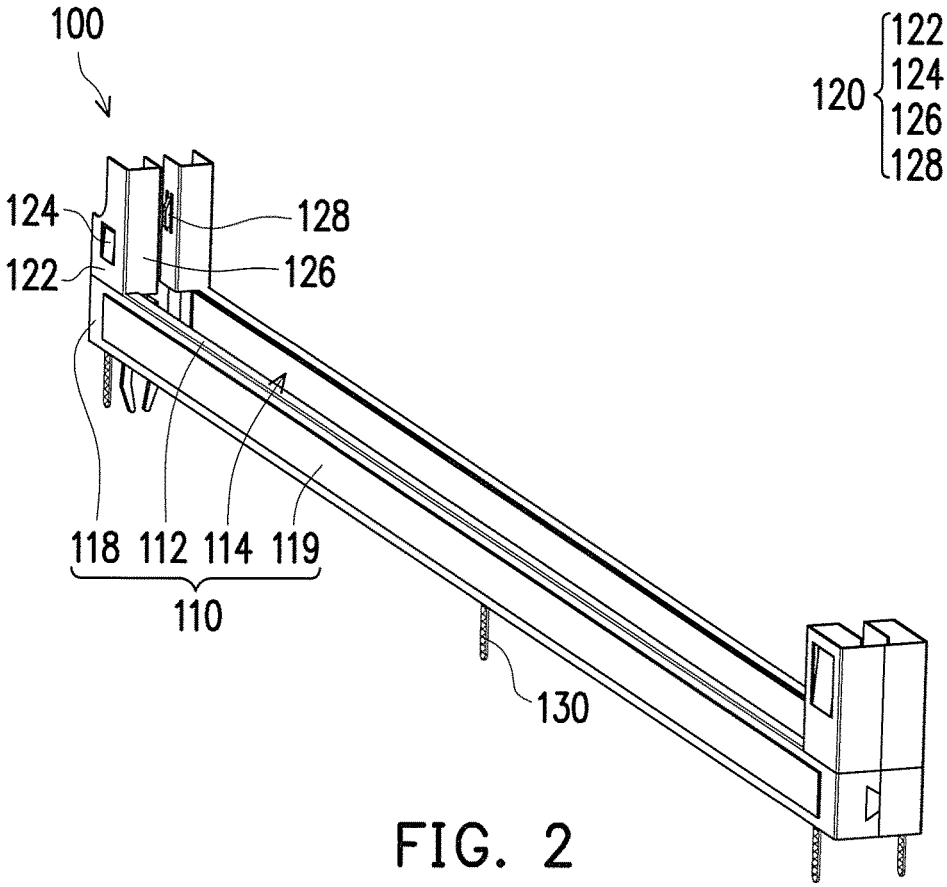
FIG. 2 and FIG. 3 are schematic diagrams illustrating a connector cover of the connector module of FIG. 1 from different view angles.
Figure 3:
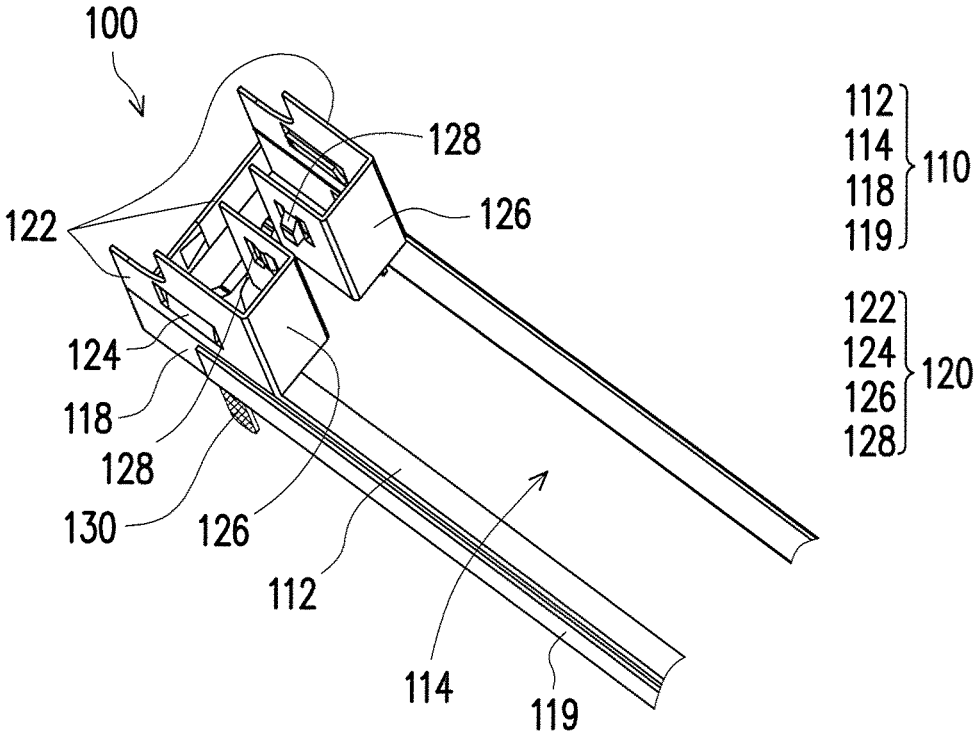
Figure 4:
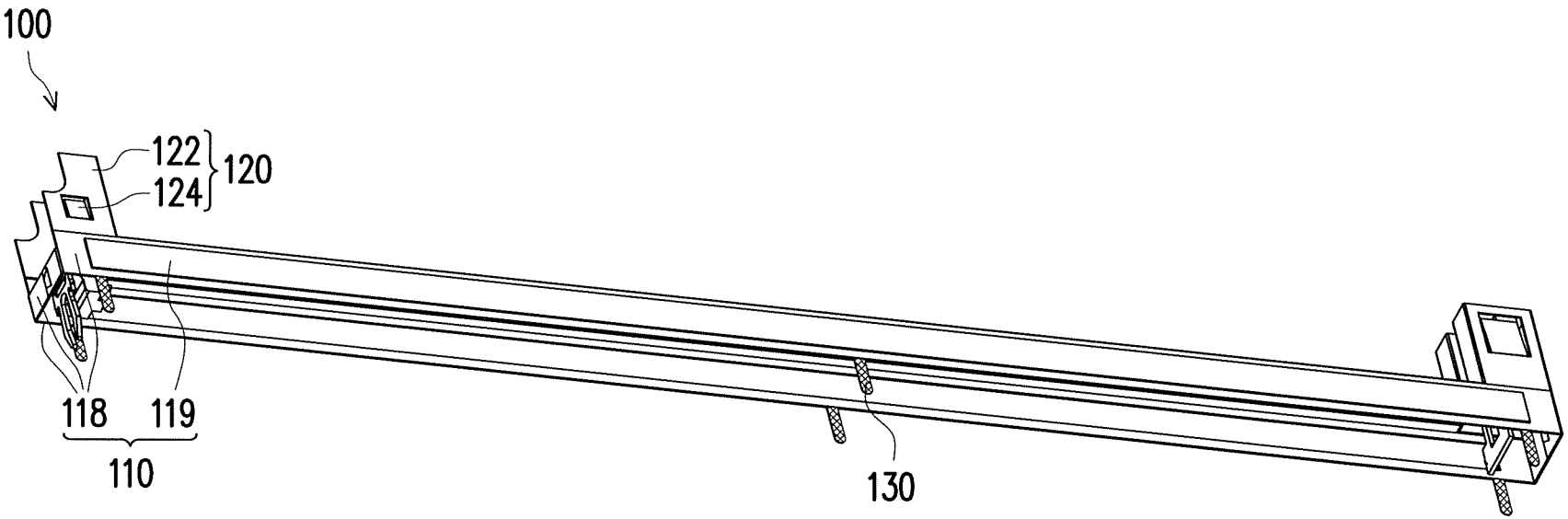
FIG. 4 is a partial schematic diagram of a connector cover of the connector module of FIG. 1.
Figure 5:
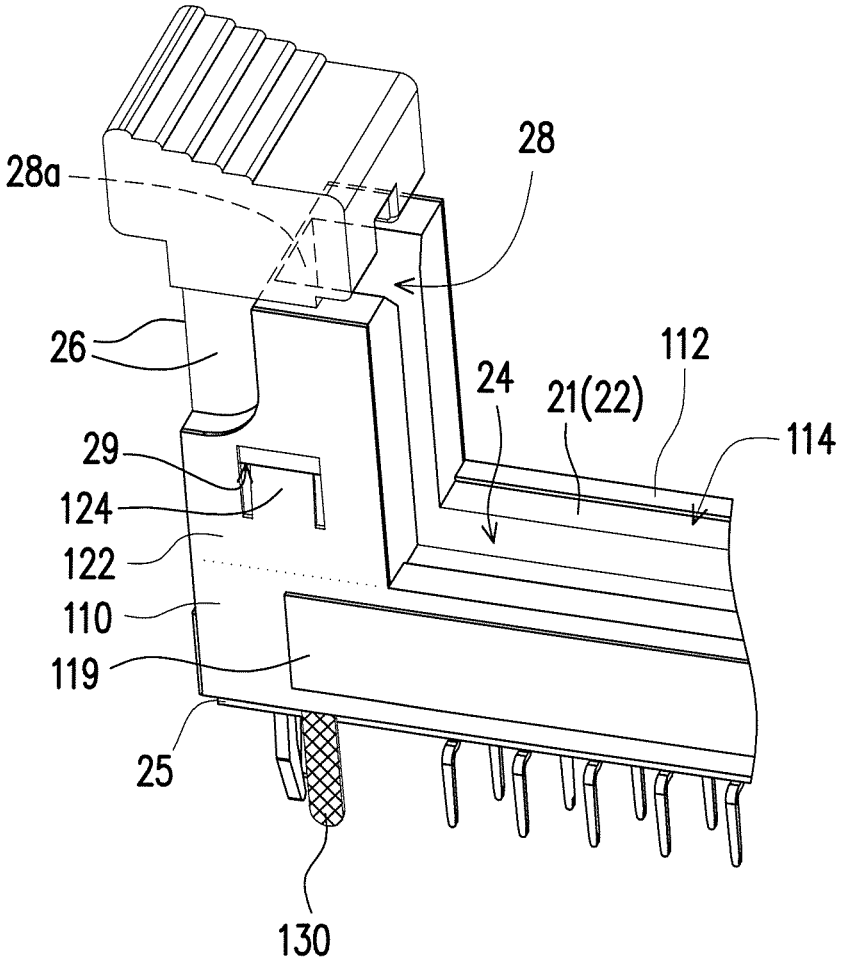
FIG. 5 is a partial schematic diagram of the connector module of FIG. 1.

FIG. 1 is a schematic diagram illustrating a connector module according to an embodiment of the invention. FIG. 2 and FIG. 3 are schematic diagrams illustrating a connector cover of the connector module of FIG. 1 from different view angles. FIG. 4 is a partial schematic diagram of a connector cover of the connector module of FIG. 1. FIG. 5 is a partial schematic diagram of the connector module of FIG. 1. In FIG. 1 and FIG. 5, lines illustrating a connector cover 100 are intentionally thickened, so as to clearly distinguish the connector cover 100 and a connector 20.

Referring to FIG. 1 and FIG. 5, a connector module 10 of the embodiment includes a connector 20 and a connector cover 100. In the present embodiment, as an example, the connector 20 is described as a memory module connector, however the type of the connector 20 is not limited thereto. The connector 20 includes a connector body 21 and two protrusions 26 protruding upwards and located at two ends of the connector body 21 respectively. In the present embodiment, in order to more accurately describe the positioning, the connector 20 is divided into the connector body 21 which has a similar height from left to right and the two protrusions 26 located on top the two ends of the connector body 21. The connector body 21 includes a connector top surface 22 and four connector side surfaces 25, wherein the connector top surface 22 includes a connector slot 24. The connector slot 24 may provide removable insertion of a memory module (not shown) such that the memory module and a main board (not shown) can be electrically connected.

Each of the protrusions 26 includes an protrusion inner wall 27 and a groove 28 caved in the protrusion inner wall 27, and the protrusion inner walls 27 of the two protrusions 26 face towards each other. The two grooves 28 are communicated with the connector slot 24. When an expansion card (for example a memory module) is inserted into the connector 20, the expansion card will slide into the connector slot 24 of the connector body 21 along the two grooves 28 of the two protrusions 26.

For example, if the expansion card is a memory module, the left and right sides of the memory module will have a partially concave contour. In a conventional connector, typically two latches are disposed at the two sides of the groove of the left end or right end of the connector 20. The location of the two latches correspond to the concave part of one of the left and right ends of the memory module. That is to say, during the process of inserting the memory module into the slot of the connector, a circuit board of the memory module will push apart the two latches slightly due to a particular thickness of the circuit board until when the memory module is positioned, then the two latches will be positioned at the concave part of the memory module and slightly abut against the memory module such that the memory module does not separate from the connector easily. However, if the latch and the connector are manufactured together by a plastic injection molding method, problems such as wear due to not being durable against plugging and pulling, and difficulty in controlling the dimension of the molded part arises. If additional metal pieces are used to be inserted into the protrusions at the left and right two ends of the connector as metal latches, then additional components and processing steps are required. Furthermore, the positions of the metal latches are also difficult to control.

In the present embodiment, in addition to the connector module 10 protecting the connector 20 through the connector cover 100, the connector cover 100 is also specially designed to act directly as the latch for the expansion card to provide an effect to stably fix the expansion card which is inserted into the connector 20. Details are described below.

Referring to FIG. 1 through FIG. 5, the connector cover 100 includes a cover body 110 and at least one cover protrusion 120 located at least one end of the cover body 110. Using the same dividing method as the connector 20, in the present embodiment, the connector cover 100 is divided into the cover body 110 which has a similar height from left to right and the cover protrusion 120 located on top of at least one end of the cover body 110.

The cover body 110 includes a cover top surface 112 and four cover side surfaces 118. The cover top surface 112 covers the connector top surface 22, and includes an opening 114 corresponding to the connector slot 24. More specifically, in the present embodiment, the cover top surface 112 only covers a partial region on the connector top surface 22 that is closer to the two connector side surfaces 25 having greater length. Therefore, a width of the opening 114 of the cover top surface 112 is larger than a width of the connector slot 24 of the connector top surface 22, such that a portion of the connector top surface 22 is still exposed by the cover top surface 112. Of course, in other embodiments, the cover top surface 112 may also cover the entire connector top surface 22 and only expose the connector slot 24. However, the configurations of the cover top surface 112 is not limited hereto.

The four cover side surfaces 118 cover the four connector side surfaces 25. The four cover side surfaces 118 connect with each other to form a closed rectangle, wherein two opposite of the cover side surfaces 118 connect to the cover top surface 112 respectively. In addition, in the present embodiment, the connector cover 100 includes two cover protrusions 120 located at the left and right two ends of the cover body 110 and protruding from the cover top surface 112 such that the connector cover 100 has a greater height at the left and right two ends. In the present embodiment, the two cover protrusions 120 may cover the protrusions 26 near the two ends of the connector 20. More specifically, each of the cover protrusions 120 includes at least two cover protrusion side surfaces 122. The two cover protrusion side surfaces 122 cover the two opposite connector side surfaces 25 respectively. As may be seen from FIG. 1, the connector cover 100 roughly corresponds to a form of the connector 20 so as to provide a more complete protection to the connector 20. Therefore, a breaking probability of the connector 20 of the connector module 10 of the present embodiment which is caused by a heavier expansion card may be lowered.

As shown in FIG. 3 to FIG. 5, each of the cover protrusions 120 further includes at least one covering portion 126. Each of the covering portions 126 extends from one of the cover protrusion side surfaces 122 and curves along a contour of the protrusion inner wall 27 and covers at least a part of the protrusion inner wall 27. More specifically, in the present embodiment, each of the cover protrusions 120 includes two covering portions 126, extending and curving from two of the cover protrusion side surfaces 122 respectively, and covering the surface of the protrusion inner wall 27. Each of the covering portions 126 includes a protruding arm 128, wherein the protruding arm 128 extends into the groove 28.

In the present embodiment, the two opposite protruding arms 128 extend into the groove 28 and may act as latches to fix the expansion card. Compared to a traditional plastic latch that is molded together with the connector, it is more durable to use the two protruding arms 128 of the connector cover 100 of the present embodiment to act as latches for the expansion card since the material of the connector cover 100 of the present embodiment may be metal. In addition, compared to a conventional method of additionally inserting a metal latch in the connector, the protruding arm 128 can be positioned by assembling the connector cover 100 of the present embodiment to the connector 20, so that it does not require additional components or processing steps. Furthermore, because the location of the protruding arm 128 is more controllable, the issue that it is difficult to control the tight or loose situation between the two opposite protruding arms 128 can be prevented.

In addition, each of the protrusions 26 includes two positioning grooves 29 located at two of the outer surfaces which are opposite to each other. Each of the cover protrusion side surfaces 122 includes a positioning arm 124, wherein the two positioning arms 124 of the cover protrusion side surfaces 122 are slanted towards each other. A top end of the positioning arm 124 is adapted to abut against an upper wall surface of the positioning groove 29. Therefore, in the present embodiment, when the connector cover 100 is arranged on the connector 20, the four cover side surfaces 118 abut against the four connector side surfaces 25 such that the connector cover 100 does not move leftward, rightward, frontward or backward with respect to the connector 20. The cover top surface 112 abuts against the connector top surface 22 such that the connector cover 100 does not move downwards easily with respect to the connector 20. The top end of the positioning arm 124 abuts against the upper wall surface of the positioning groove 29 such that the connector cover 100 does not move upwards to separate from the connector 20.

In addition, the connector cover 100 includes at least one connecting pin 130 extending from one of the cover side surfaces 118. More specifically, in the present embodiment, the connector cover 100 includes six connecting pins 130, wherein two connecting pins 130 make a pair which extend from the two opposite cover side surfaces 118 towards a direction away from the cover top surface 112. The connector cover 100 of the present embodiment is connected and fixed to the main board by the connecting pins 130. That is to say, the connector cover 100 of the present embodiment is capable of being fixed to the main board together with the pins of the connector 20 through the connecting pins 130 (for example, by a method of inserting the connecting pins 130 and the pins of the connector 20 into corresponding holes on the main board, then filling solder), such that the connector cover 100 may be arranged on the connector 20 even more stably. Of course, the number and location of the connecting pins 130 are not limited hereto.

In the present embodiment, the connecting pin 130 has a rough surface capable of enhancing the adhesiveness of the solder. In the present embodiment, the rough surface has a plurality of rhombus bumps such that the surface is uneven and rough. The rough surface may be formed through pressing. However, in other embodiments, uniform or non uniform strips may be scratched on the connecting pin 130 to form the rough surface. Or, the rough surface may be formed by sandblasting treatment. The pattern and the method of forming the rough surface on the connecting pin 130 is not limited hereto.

Of course, in other embodiments, other methods may be used to increase the connection strength between the connecting pins 130 and the main board. For example, a bending part that is pressed but not cut or a breach that is cut may be formed on the connecting pin 130 through pressing. When the connecting pin 130 is to be fixed to the main board, some soldering material may be at a location where the bending part is recessed or at the breach, to increase the connection strength between the connecting pin 130 and the main board.

It should be noted, in the present embodiment, the connecting pins 130 are ground pins. That is to say, when the connecting pins 130 are fixed to the main board, the connecting pins 130 contact a grounding wire of the main board to achieve a function of grounding. In other words, in addition to having a fixing function, the connecting pins 130 of the connector cover 100 also may provide an effect of preventing electromagnetic interference.

In addition, in the present embodiment, in order to prevent a reduction of space on the main board when the connector cover 100 is disposed on the connector 20, a thickness of the connector cover 100 is restricted. For example, in the present embodiment, the thickness of the connector cover 100 is approximately 0.15 millimeters. However, a metal plate this thin typically has poor stiffness. Therefore, in the present embodiment, the cover side surfaces 118 of the connector cover 100 have a special design such that a connector cover 100 with a lesser thickness still may have sufficient strength to protect the connector 20.

More specifically, in the present embodiment, in the two cover side surfaces 118 with the greater length, each of the cover side surfaces 118 includes a protruding rib part 119. Since the stiffness of metal is increased after the metal is bent and pressed, the overall structural strength of the connector cover 100 of the present embodiment is further increased by the rib part 119. Of course, in other embodiments, the rib part 119 may also be recessed. In addition, even though each of the cover side surfaces 118 having greater length has a longer rib part 119 in the present embodiment, in other embodiments, each of the cover side surfaces 118 may also have a plurality of discontinuous ribs parts 119. The configuration, number and location of the rib part 119 is not limited to those shown in the drawings.

It is worthy to note, the configuration of the connector cover 100 is not limited to the aforementioned. A number of other configurations of the connector cover 100 is described below. In these embodiments, the same reference numbers are used in the drawings and the description to refer to the same or like parts and will not be repeated here.

Figure 6:
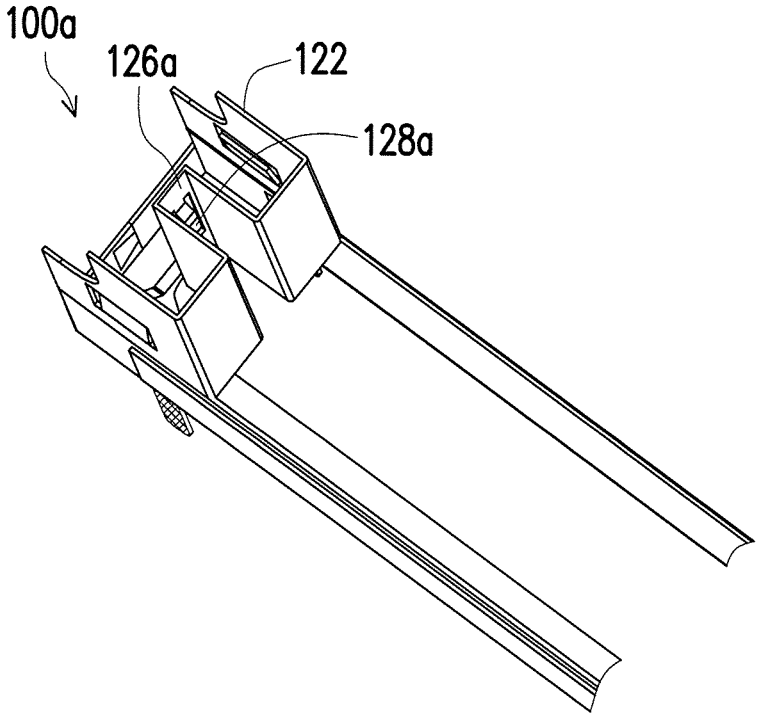
FIG. 6 is a partial schematic diagram of a connector cover according to another embodiment of the invention.

FIG. 6 is a partial schematic diagram of a connector cover according to another embodiment of the invention. Referring to FIG. 6, a main difference between a connector cover 100*a* of FIG. 6 and the connector cover 100 of FIG. 4 lies in, in the present embodiment, the connector cover 100*a* only has one covering portion 126*a*. The covering portion 126*a* extends from the cover protrusion side surface 122 and curves at least twice along the contour of the protrusion inner wall 27 (labelled in FIG. 1) and covers a bottom surface 28*a* (labelled in FIG. 5) of the groove 28. More specifically, in the present embodiment, the covering portion 126*a* curves four times along the contour of the protrusion inner wall 27 and the covering portion 126*a* is attached to the entire protrusion inner wall 27. In addition, in the present embodiment, a protruding arm 128 is located on a portion of the covering portion 126*a* covering the bottom surface 28*a* of the groove 28. The location of the protruding arm 128*a* of the present embodiment corresponds to the concave part at the left and right two sides of the expansion card, and the contour of the protruding arm 128*a* may correspond to the contour of the concave at the left and right two sides of the expansion card, and is adapted to abut against a wall surface of the concave part of the expansion card to achieve an effect of fixing the expansion card.

In addition, the covering portion 126*a* is connected to the two cover protrusion side surfaces 122 in the present embodiment, however in other embodiments, the covering portion 126 may also only be connected to one of the cover protrusion side surfaces 122. The range of the covering portion 126*a* covering the protrusion inner wall 27 and the connecting relationship with the cover protrusion side surfaces 122 are not limited hereto.

Figure 7:
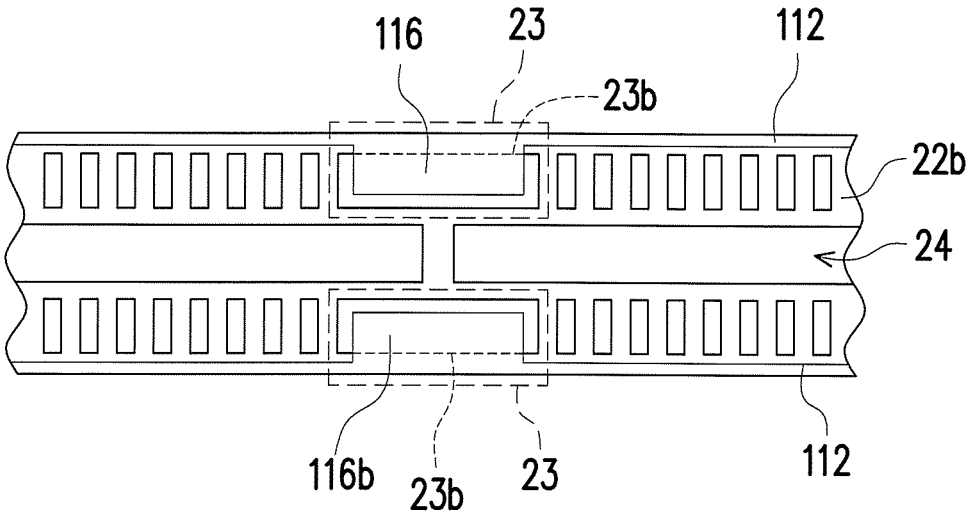
FIG. 7 is a partial schematic plan view diagram of a connector module according to another embodiment of the invention.
Figure 8:
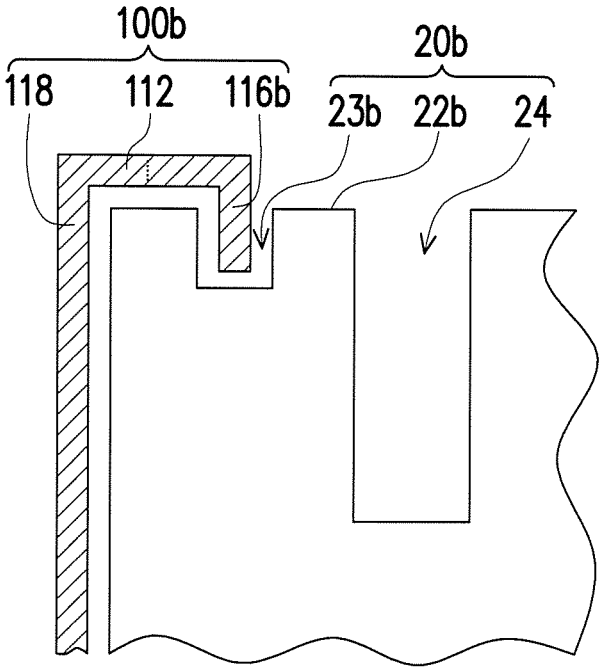
FIG. 8 is a cross-sectional schematic diagram taken along a line A-A of FIG. 7.

FIG. 7 is a partial schematic plan view diagram of a connector module according to another embodiment of the invention. FIG. 8 is a cross-sectional schematic diagram taken along a line A-A of FIG. 7. Referring to FIG. 7 and FIG. 8, a connector top surface 22*b* of a connector 20*b* includes a pin-less hole region 23 and a depressed part 23*b* depressed in the pin-less hole region 23. In the present embodiment the pin-less hole region 23 is located at the connector top surface 22*b* close to a central location. The cover top surface 112 of a connector cover 100*b* includes an engaging part 116*b*. As shown in FIG. 8, the depressed part 23*b* is not located at an edge of the connector top surface 22*b*, and the engaging part 116*b* may be bent so that an end extends into the depressed part 23*b* such that the connector cover 100*b* may be fixed to the connector 20*b* more stably.

Figure 9:
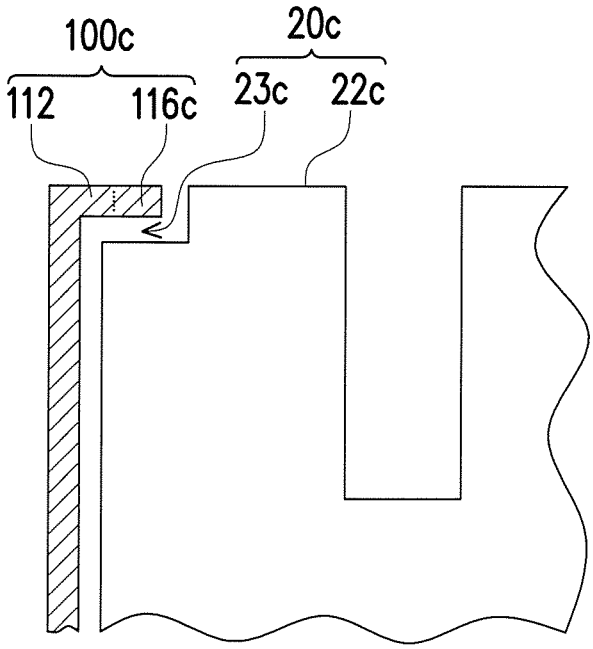
FIG. 9 is a partial cross-sectional schematic diagram of a connector module according to another embodiment of the invention.

FIG. 9 is a partial cross-sectional schematic diagram of a connector module according to another embodiment of the invention. Referring to FIG. 9, a main difference between the present embodiment and the afore mentioned embodiment lies in, in the present embodiment, a depressed part 23*c* of a connector 20*c* is located at an edge of the connector top surface 22*c*. Therefore, an engaging part 116*c* and the cover top surface 112 which is connected with the engaging part 116*c* will extend into the depressed part 23*c* together. In addition, in the present embodiment, a depth of the depressed part 23*c* is greater than or equal to a thickness of the engaging part 116*c*, such that the engaging part 116*c* and the cover top surface 112 will not be higher than the connector top surface 22*c* after extending into the depressed part 23*c*.

In summary, in the invention, in addition to a connector cover covers a connector such that the connector module may have better strength, the connector cover also has a design wherein a covering portion of a cover protrusion extends from one of the cover protrusion side surfaces and curves along a contour of an protrusion inner wall and covers at least a part of the protrusion inner wall and an protruding arm of the covering portion extends into a groove, such that the protruding arm may be used to act, for example, as a latch to fix a concave portion of a side surface of a expansion card such as a memory module. A material of the connector cover may be metal and is more durable compared to a plastic latch that is molded together with the connector. In addition, compared to a conventional method of additionally inserting a metal latch in the connector, while the connector cover of the invention is assembled to the connector, the protruding arm is positioned, and does not require additional components or processing steps. Furthermore, compared to a conventional connector, because the location of the protruding arm is more controllable, the issue that it is difficult to control the tight or loose situation between the two opposite protruding arms can be prevented.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A connector cover, adapted to cover a connector, wherein the connector includes a connector body and two protrusions, the connector body includes a connector top surface and four connector side surfaces, the connector top surface includes a connector slot, the two protrusions are respectively located at two ends of the connector body and protrude from the connector top surface, the two protrusions respectively include two protrusion inner walls facing towards each other and two grooves caved in the protrusion inner walls, the two grooves communicate to the connector slot, the connector cover comprising:

a cover body, comprising:

a cover top surface, adapted to cover the connector top surface, and comprising an opening corresponding to the connector slot; and four cover side surfaces, adapted to cover the four connector side surfaces, wherein two of the cover side surfaces which are opposite to each other connect to the cover top surface; and at least one cover protrusion, located at at least one end of the cover body and protruding from the cover top surface, each of the cover protrusions comprising:

two cover protrusion side surfaces, adapted to cover two of the connector side surfaces which are opposite to each other; and at least one covering portion, each of the covering portions extending from one of the cover protrusion side surfaces and adapted to curve along a contour of the protrusion inner wall and cover at least a part of the protrusion inner wall, each of the covering portions comprising a protruding arm, wherein the protruding arm is adapted to extend into the groove.

2. The connector cover as claimed in claim 1, wherein each of the cover protrusions comprises the two covering portions which respectively extend from the two opposite cover protrusion side surfaces and curve, and are adapted to cover two opposite surfaces of the protrusion inner wall.

3. The connector cover as claimed in claim 1, wherein each of the cover protrusions comprises one of the covering portions, which extends from one of the cover protrusion side surfaces and adapted to curve at least twice along the contour of the protrusion inner wall and cover a bottom surface of the groove, and the protruding arm is located on a part of the covering portion covering the bottom surface of the groove.

4. The connector cover as claimed in claim 3, wherein the covering portion is attached to the entire protrusion inner wall.

5. The connector cover as claimed in claim 1, wherein the connector top surface of the connector comprises a pin-less hole region and a depressed part depressed in the pin-less hole region, the cover top surface comprises an engaging part, the engaging part extends into the depressed part, the depressed part is located at an edge of the connector top surface, a depth of the depressed part is greater than or equal to a thickness of the engaging part.

6. The connector cover as claimed in claim 1, wherein the connector top surface of the connector comprises a pin-less hole region and a depressed part depressed in the pin-less hole region, the cover top surface comprises an engaging part, the depressed part is not located at an edge of the connector top surface, the engaging part is bent so that an end of the engaging part extends into the depressed part.

7. The connector cover as claimed in claim 1, further comprising:

at least one connecting pin, extending from one of the cover side surfaces, wherein the connector cover is adapted to connect to a main board by the at least one connecting pin.

8. The connector cover as claimed in claim 7, wherein the at least one connecting pin is a ground pin.

9. The connector cover as claimed in claim 7, wherein each of the connecting pins has a rough surface, a bending part or a breach, the rough surface comprises a sand blasted surface or comprises a plurality of uniform or non uniform strips or bumps.

10. The connector cover as claimed in claim 1, wherein each of the protrusions comprises two positioning grooves located at two opposite outer surfaces, the two opposite cover protrusion side surfaces respectively comprises two positioning arms slanted towards each other, top ends of the two positioning arms are adapted to abut against upper wall surfaces of the two positioning grooves.

11. A connector module, comprising:

a connector, comprising:

a connector body, comprising a connector top surface and four connector side surfaces, the connector top surface including a connector slot, two protrusions, respectively located at two ends of the connector body and protruding from the connector top surface, the two protrusions respectively including two protrusion inner walls facing towards each other and two grooves caved in the two protrusion inner walls, the two grooves communicating to the connector slot; and a connector cover, covering the connector, the connector cover comprising:

a cover body, comprising:

a cover top surface, covering the connector top surface, and comprising an opening corresponding to the connector slot; and four cover side surfaces, covering the four connector side surfaces, wherein the two cover side surfaces opposite to each other connect to the cover top surface; and at least one cover protrusion, located at at least one end of the cover body and protruding from the cover top surface, each of the cover protrusions comprising:

two cover protrusion side surfaces, covering two of the connector side surfaces which are opposite to each other; and at least one covering portion, each of the covering portions extending from one of the cover protrusion side surfaces and curving along a contour of the protrusion inner wall and covering at least a part of the protrusion inner wall, each of the covering portions comprising a protruding arm, wherein the protruding arm extends into the groove.

12. The connector module as claimed in claim 11, wherein each of the cover protrusions comprises two of the covering portions which extend from the two cover protrusion side surfaces opposite to each other and curve so as to cover two surfaces of the protrusion inner wall opposite to each other.

13. The connector module as claimed in claim 11, wherein each of the cover protrusions comprises one of the covering portions, which extends from one of the cover protrusion side surfaces and curves at least twice along the contour of the protrusion inner wall so as to cover a bottom surface of the groove, and the protruding min is located on a part of the covering portion covering the bottom surface of the groove.

14. The connector module as claimed in claim 13, wherein the covering portion is attached to the entire protrusion inner wall.

15. The connector module as claimed in claim 11, wherein the connector top surface of the connector comprises a pin-less hole region and a depressed part depressed in the pin-less hole region, the cover top surface comprises an engaging part, the engaging part extends into the depressed part, the depressed part is located at an edge of the connector top surface, a depth of the depressed part is greater than or equal to a thickness of the engaging part.

16. The connector module as claimed in claim 11, wherein the connector top surface of the connector comprises a pin-less hole region and a depressed part depressed in the pin-less hole region, the cover top surface comprises an engaging part, the depressed part is not located at an edge of the connector top surface, the engaging part is bent so that an end of the engaging part extends into the depressed part.

17. The connector module as claimed in claim 11, further comprising:

at least one connecting pin, extending from one of the cover side surfaces, wherein the connector cover is adapted to connect to a main board by the at least one connecting pin.

18. The connector module as claimed in claim 17, wherein the at least one connecting pin is a ground pin.

19. The connector module as claimed in claim 17, wherein each of the connecting pins has a rough surface, a bending part or a breach, the rough surface comprises a sand blasted surface or comprises a plurality of uniform or non uniform strips or bumps.

20. The connector module as claimed in claim 11, wherein each of the protrusions comprises two positioning grooves located at two outer surfaces opposite to each other, the two opposite cover protrusion side surfaces comprises two positioning arms slanted towards each other, top ends of the two positioning arms abut against upper wall surfaces of the two positioning grooves.

* * * * *